US005228166A

United States Patent [19]

Gomez

[11] Patent Number: 5,228,166

[45] Date of Patent: Jul. 20, 1993

[54] REMOVABLE PIVOTABLE HEAD TOOTHBRUSH

[76] Inventor: Jesus C. Gomez, 5331 N. Glenwood, Chicago, Ill. 60640

[21] Appl. No.: 906,570

[22] Filed: Jun. 30, 1992

[51] Int. Cl.[5] ..... A46B 9/04

[52] U.S. Cl. ..... 15/167.1; 15/172; 15/176.6; 15/202; 403/154

[58] Field of Search ..... 15/145, 146, 147.1, 15/150, 172, 176.1, 176.4–176.6, 178, 194, 201, 202, 167.1; 403/154, 157, 161, 315, 330

[56] References Cited

U.S. PATENT DOCUMENTS

| | | | |
|---|---|---|---|
| 1,706,555 | 3/1929 | Weis | 15/172 |
| 1,742,596 | 1/1930 | Hoff | 15/172 |
| 1,843,008 | 1/1932 | Waters | 15/147.1 |
| 2,002,320 | 5/1935 | Jones | 15/172 |
| 2,091,716 | 8/1937 | Petta | 15/172 |
| 4,008,513 | 2/1977 | Griffiths | 403/315 |
| 4,333,199 | 6/1982 | Del Rosario | 15/167.1 |
| 4,399,582 | 8/1983 | Ernest et al. . | |
| 4,488,328 | 12/1984 | Hyman | 15/167.1 |
| 4,731,896 | 3/1988 | de La Tour | 403/157 |

FOREIGN PATENT DOCUMENTS

| | | | |
|---|---|---|---|
| 1075819 | 4/1954 | France | 15/172 |
| 1291696 | 3/1962 | France | 403/161 |
| 2450579 | 11/1980 | France | 15/176.5 |
| 393254 | 10/1965 | Switzerland | 15/176.1 |
| 191745 | 8/1923 | United Kingdom | 15/172 |
| 358966 | 4/1930 | United Kingdom | 15/176.4 |

*Primary Examiner*—Harvey C. Hornsby
*Assistant Examiner*—Mark Spisich
*Attorney, Agent, or Firm*—Ladas & Parry

[57] ABSTRACT

Disclosed is a toothbrush having a replaceable head that is held in place to the handle by a latch. The head also pivots.

6 Claims, 2 Drawing Sheets

REMOVABLE PIVOTABLE HEAD TOOTHBRUSH

FIELD OF THE INVENTION

The invention relates to a toothbrush having a removable head that pivots.

BACKGROUND OF THE INVENTION

Toothbrushes having heads that pivot longitudinally along the line of the handle provide better teeth cleaning and polishing than toothbrushes of conventional fixed head design. Toothbrushes that have removable heads are less expensive to use than conventional toothbrushes, since only the head portion need be bought when the current head is worn.

One advantage of removable head design is that a variety of head shapes can be used in conjunction with a common handle. Thus, soft bristle heads can be substituted for hard bristle heads, or gum massaging heads made of rubber or other similar material can be used with a single handle.

One of the problems associated with prior art removable head toothbrushes is that the heads, if securely fastened to the handle Were removable only with difficulty, thereby making replacement cumbersome. When the heads were easily removable they tended to loosen under tooth brushing conditions. If it were possible to provide a removable head tooth brush that pivoted and was securely fastened to the handle yet easily removable an advantage to the art of dental hygiene would be afforded.

SUMMARY OF THE INVENTION

The invention provides an improved toothbrush that has a replaceable head which pivots longitudinally along the line of the handle. The head is securely fastened by a latch located in the handle of the brush. The latch, when it is the locked position, is held in place by a compression spring which permits the latch to be easily disengaged to allow removal and replacement of the head. The head pivots utilizing a unique grooved rail and slot design.

THE DRAWINGS

For a better understanding of the invention reference may be had to the drawings in which like parts have like numbers.

THE INVENTION

Figure 1:
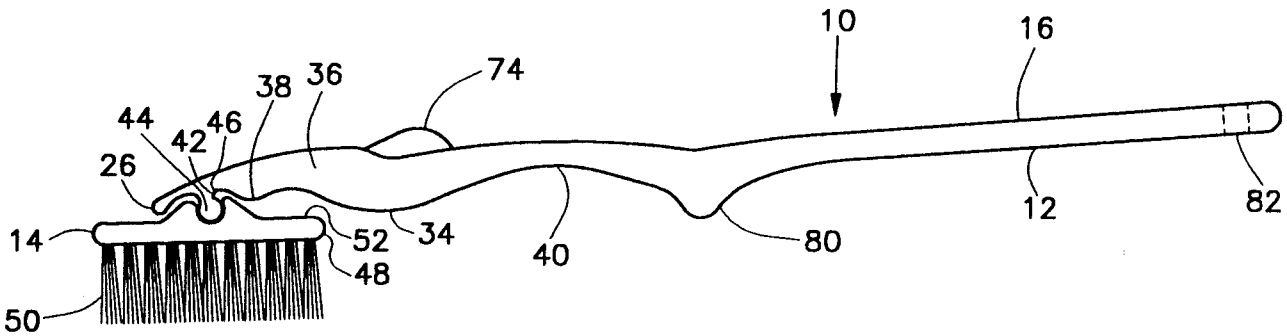
FIG. 1 is a side view of the toothbrush of the invention.

With specific reference to the drawings there is shown in FIG. 1 a toothbrush designated generally by the numeral 10. It is composed of two main elements, the handle 12 and a replaceable head 14.

Figure 2:
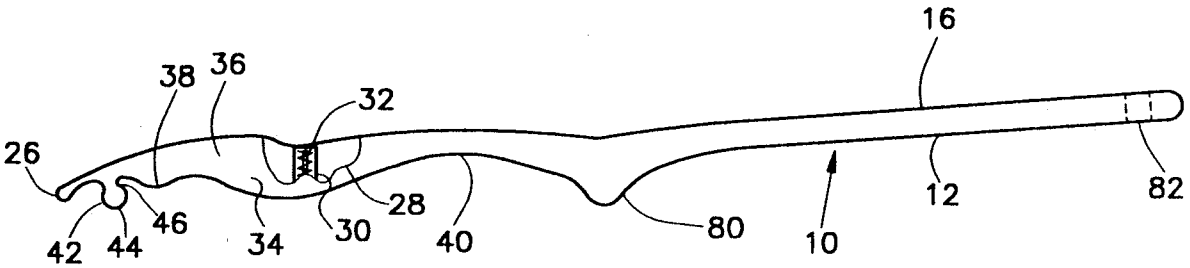
FIG. 2 is a cutaway view of FIG. 1 absent the replaceable head and the latch button.
Figure 3:
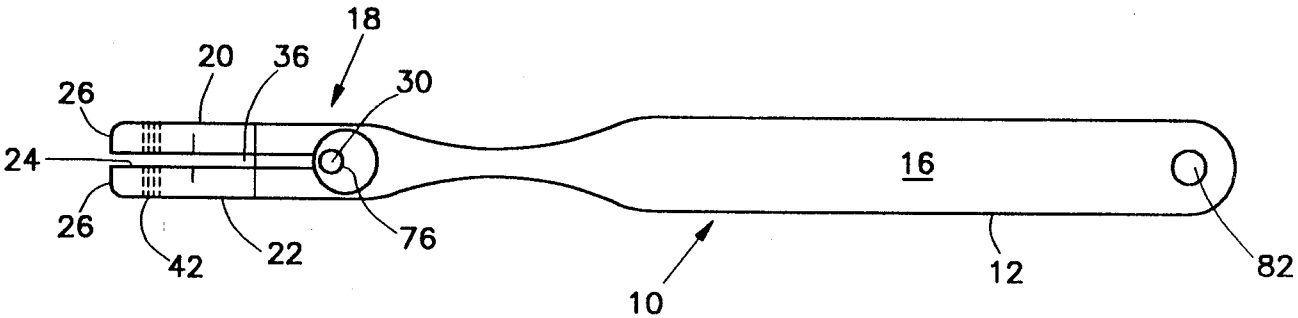
FIG. 3 is a top view of FIG. 2.

The handle 12 is elongated. As shown in FIG. 3, the top 16 of the handle 12 has a tapered neck which flares into a forked head 18. The branches 20 and 22 of the fork define a rectangular space 24. FIGS. 1 and 2 show the tip end of the forks 26 is downwardly curved and slightly tapered. These tips function as a stop to limit the degree of arc the replaceable head 14 may travel.

FIG. 3 shows located in the top 16 of the handle 12, behind the forked head 18, recess 28 which accommodates the bottom or one end 30 of a small compression spring 32. The recess 28 may be configured to receive a latch button described more fully hereafter.

FIGS. 1 and 2 show the sides of forked head 18 of the handle 12 to be composed of several curved segments. The first of such segments 34 is the largest. It is in the area of recess 28. Forward of first segment 34 and extending through branches 20 and 22 of the forked head 18 are pin holes holding 36. The second curved segment 38, located near the end 26 of the forked head 18, is shown to be in the form of a gentle "V" shaped wave. This second segment functions as a second stop to limit the opposite degree of arc the replaceable head 14 may travel.

Adjacent the ends 26 of the forked head 18 and located on the bottom 40 of the handle 12 is a grooved rail 42. This grooved rail is perpendicular to, downwardly depends from and is attached to both branches 20 and 22 of the forked head 18. FIGS. 1 and 2 show the grooved rail 42 to have a knob shaped head 44 and grove 46.

Figure 7:
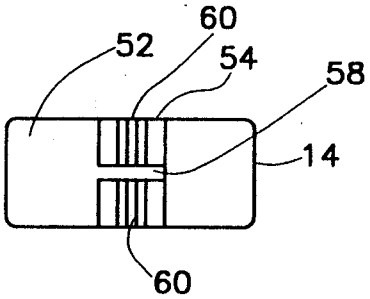
FIG. 7 is a top view of FIG. 6.
Figure 6:
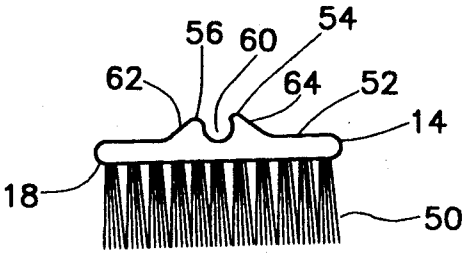
FIG. 6 is a side view of a replaceable head assembly.

The replaceable head 14 is shown in FIGS. 6 and 7 to be rectangular in shape. Its bottom 48 contains bristles 50 which may be nylon and configured in known patterns for optimum teeth cleaning effectiveness. The top 52 of the replaceable head 14 is flat but its center portion 54 flares upwardly to form a triangular shaped ridge 56 which extends across the width of the top 52 of the replaceable head. The triangular shaped ridge at is center contains a grove 58 whose width corresponds generally to the width of the space 24 between the branches 20, 22 of the forked head 18. This grove is best illustrated in FIG. 7. The triangular ridge 56 contains at its apex a knobbed shaped opening 60 which is of slightly greater dimension than the grooved rail 42. The knob shaped opening slides over the knob shaped rail and engages the groove thereby attaching the replaceable head 14 to the handle 12.

The replaceable head 14 extends below and is in spaced apart relationship from the forked head 18. It is in loose fitting relationship to the forked head 18 of the toothbrush hence it is free to pivot in a direction longitudinal to the length of the handle 12. The sides 62 and 64 of the triangular shaped ridge 56 are shaped to respectively and uniformly engage curved end 26, and curved segment 38, of the forked head 18. This arrangement sets the amount of pivotal motion the replaceable head 14 will undergo when teeth are brushed.

Figure 5:
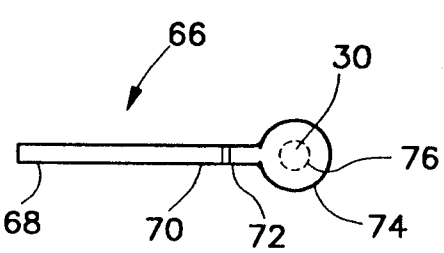
FIG. 5 is a top view of FIG. 4.
Figure 4:
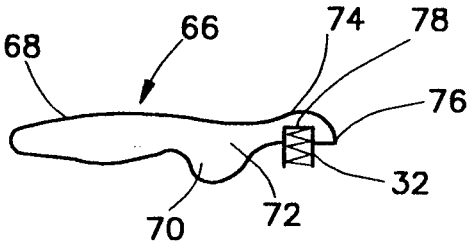
FIG. 4 is a cut-away side view of the latch.

To maintain the replaceable head 14 in a fixed or locked position onto the forked head 18 of the handle 12 there is provided a latch 66 which is detailed in FIGS. 4 and 5. The latch is composed of a flat bottomed tongue 68, which is the first section of the latch. The second section of the latch is a fulcrum segment 70 which contains a hole 72 which is adapted to receive pin 36. The third section is a rounded, hemispherical button 74 which is sized to be at least partially received into the recess 28 in the top 16 of the handle 12. The interior of the button 74 contains a recess 76 to receive the top end 78 of the compression spring 32. The latch corresponds in side configuration to the shape of curved segments 34 and 38.

FIGS. 1 and 2 show a curved projection 80 on the handle 16 which is optional yet allows a more comfortable fit of the brush to the users mouth. Another optional feature is the provision of a hole 82 in the back end of the handle 14 which allows the brush to be hung on a hook or nail.

To assemble)e the toothbrush of the invention the latch 66 is inserted into the space 24 of the forked head 18. The top end 78 of the compression spring 32 is inserted into recess 76, located in the button 74. The bottom end 30 of the compression spring is inserted into recess 28 located in the top 16 of the handle 12. The pin hole 72 of the latch is aligned with the corresponding holes in the fork which hold pin 36. The latch button 7 being urged upwardly by compression spring 32 pivots the tongue section 68 downwardly below the bottom of the forked head 18.

To insert the replaceable head 14 on the handle 12 button 74 is depressed which raises the tongue section 68 into forked head 18. It is now but a simple matter to slide the knob shaped opening 60 of the replaceable head 14 onto the grooved rail 42 until the space between the forks 24 is aligned with the grove 58 in the top 52 of the replaceable head 14. Once this alignment is achieved the button 74 of the latch 66 is released allowing the bottom of the tongue section 68 of the latch 62 to mate with and engage grove 58 of the replaceable head 14. To remove the replaceable head 14 the button 74 is depressed and the removable head 14 is easily disengaged by sliding it off the grooved rail 42. The pressure required to pivot the replaceable head 14 may be varied by changing he stiffness of compression spring 32.

The toothbrush of the invention may be constructed using conventional plastics now used in the manufacture of tooth brushes. The bristles, as indicated, may be made of nylon. The remainder of the toothbrush may use such plastics as high density polypropylene, nylon, acrylate esters and the like. The pin 36 and the compression spring 32 should be constructed of steel, either stainless or chrome plated steel to provide strength and durability.

Numerous advantages are afforded by the toothbrush of this invention. The pivot action allows the bristles to adjust to the users teeth, thus providing better cleaning. It is less costly to purchase a replaceable head rather than a new toothbrush. Heads having different shapes, hardness of bristles and gum massaging pads are readily interchangeable. Since the replaceable heads are smaller than conventional toothbrushes when they are discarded they make less impact on the environment.

Having thus described my invention it is claimed as follows:

1. A toothbrush having a replaceable head, comprising a forked head handle having a top, a bottom, two sides and a plurality of branches and, positioned on the bottom of each branch of the forked head and perpendicular to and near the tip of the forked head, a grooved rail; rearward of the grooved rail, a pivot pin extending between the branches of the forked head; and latch assembly positioned to pivot within the space defined by the branches which latch comprises a tongue section, an intermediate fulcrum section containing a hole sized to receive the pivot pin and a rear button section adapted to receive one end of a compression spring; an recess in the top of the handle behind the forked head, which recess is dimensioned to receive the other end of the compression spring; the compression spring positioned between the button of the latch and the recess in the top of the forked head handle; a brush head assembly containing on its bottom bristles and on its top a first elevated slot dimensioned to slideably and loosely engage the grooved rail and maintain a space between the brush head assembly and the forked head to allow the brush head assembly to pivot longitudinally in relation to the forked head handle; a second slot generally perpendicular to said first slot and parallel to the opening of the forked head positioned to engage the tongue section of the latch when the latch is closed; and with the top of the brush being of sufficient size to extend beyond the tip of the forked head of the handle.

2. The toothbrush of claim 1 where the bottom of the forked head contains stops to limit the amount of pivot of the brush head assembly and further wherein the groove rail is knob shaped.

3. The toothbrush of claim 1 wherein the sides of the handle are curvilinear and the tongue and fulcrum sections of the latch correspond to the shape of the sides of the branches which they oppose.

4. The toothbrush of claim 1 wherein the top of the handle is recessed to receive the button section of the latch, the top of the latch being hemispherical in shape.

5. The toothbrush of claim 1 wherein the first elevated slot in the head of the brush is contained in a raised triangular shaped projection.

6. The toothbrush of claim 1 wherein the head of the brush is rectangular.

* * * * *